US012753470B2

(12) United States Patent
Ott et al.

(10) Patent No.: US 12,753,470 B2
(45) Date of Patent: Oct. 6, 2026

(54) FERROSILICON VANADIUM AND/OR NIOBIUM ALLOY, PRODUCTION OF A FERROSILICON VANADIUM AND/OR NIOBIUM ALLOY, AND THE USE THEREOF

(71) Applicant: ELKEM ASA, Oslo (NO)

(72) Inventors: Emmanuelle Ott, Oslo (NO); Eivind Gustav Hoel, Kristiansand (NO); Leander Michels, Kristiansand (NO); Cathrine Hartung, Kristiansand (NO); Ole Svein Klevan, Stjørdal (NO); Thilo Haunhorst, Osnabrück (DE)

(73) Assignee: ELKEM ASA, Oslo (NO)

( * ) Notice: Subject to any disclaimer, the term of this patent is extended or adjusted under 35 U.S.C. 154(b) by 412 days.

(21) Appl. No.: 18/552,979

(22) PCT Filed: Mar. 29, 2022

(86) PCT No.: PCT/NO2022/050077
§ 371 (c)(1),
(2) Date: Sep. 28, 2023

(87) PCT Pub. No.: WO2022/211641
PCT Pub. Date: Oct. 6, 2022

(65) Prior Publication Data

US 2024/0247346 A1 Jul. 25, 2024

(30) Foreign Application Priority Data

Mar. 30, 2021 (NO) ..... 20210412

(51) Int. Cl.
*C22C 33/08* (2006.01)
*C22C 30/00* (2006.01)
*C22C 33/00* (2006.01)
*C22C 38/06* (2006.01)

(52) U.S. Cl.
CPC ..... *C22C 33/08* (2013.01); *C22C 30/00* (2013.01); *C22C 33/006* (2013.01); *C22C 38/06* (2013.01)

(58) Field of Classification Search
CPC ..... C22C 33/006
See application file for complete search history.

(56) References Cited

U.S. PATENT DOCUMENTS

| | | | | |
|---|---|---|---|---|
| 2,168,561 | A | 8/1939 | Critchett et al. | |
| 3,383,202 | A | 5/1968 | Lynch | |
| 3,591,367 | A | 7/1971 | Perfect | |
| 3,915,693 | A * | 10/1975 | Rasmussen | C21C 7/0056 75/304 |
| 4,806,305 | A | 2/1989 | Oliver | |
| 2020/0399725 | A1 * | 12/2020 | Knustad | C21C 1/105 |

FOREIGN PATENT DOCUMENTS

| | | | |
|---|---|---|---|
| CN | 1807657 | A | 7/2006 |
| CN | 101078083 | A | 11/2007 |
| CN | 103484752 | A | 1/2014 |
| CN | 103526098 | A | 1/2014 |
| CN | 105886883 | A | 8/2016 |
| CN | 106399637 | A | 2/2017 |
| CN | 106521084 | A | 3/2017 |
| CN | 106521085 | A | 3/2017 |
| CN | 106636551 | A | 5/2017 |
| CN | 109154030 | A | 1/2019 |
| CN | 111771002 | A | 10/2020 |
| DE | 1295196 | B | 5/1969 |
| EP | 0061815 | A1 | 10/1982 |
| JP | 2019189905 | A | 10/2019 |
| RU | 2040575 | C1 | 7/1995 |
| RU | 2319779 | C1 | 3/2008 |
| SU | 740852 | A1 | 6/1980 |
| SU | 926055 | A1 | 5/1982 |
| SU | 960295 | A1 | 9/1982 |
| SU | 998560 | A1 | 2/1983 |
| TW | 201932617 | A | 8/2019 |
| UA | 76030 | U | 12/2012 |
| WO | 9524508 | A1 | 9/1995 |
| WO | 2019132670 | A1 | 7/2019 |

OTHER PUBLICATIONS

International Preliminary Report on Patentability for Corresponding International Patent Application No. PCT/NO2022/050077, 20 pages, Jun. 15, 2023.
Norwegian Search Report for Corresponding Norwegian Patent Application No. 20210412, 3 pages, Oct. 29, 2021.
International Search Report and Written Opinion for Corresponding International Patent Application No. PCT/NO2022/050077, Jun. 8, 2022, 15 pages.
Decision to Grant issued on Jun. 4, 2025 for the corresponding Ukrainian Patent Application No. a202305060, 4 pages, English translation.
Examination Report issued on Feb. 16, 2026, which corresponds to the Indian Application No. 202347071699,1 pages, with English translation.
Office Action, dated Jul. 31, 2025, which was issued for the corresponding Chinese Patent Application No. 2022800273834, 6 pages, with English translation.
Taiwanese Search Report issued for the corresponding Taiwanese patent application No. 111111633, 1 page, Apr. 18, 2023.
Search Report issued for the corresponding Russian Patent Application No. 2023127626/05(061449), 4 pages, issued Jul. 10, 2024, with English Translation.

* cited by examiner

*Primary Examiner* — Christopher S Kessler
(74) *Attorney, Agent, or Firm* — LUCAS & MERCANTI, LLP

(57) ABSTRACT

A ferrosilicon vanadium and/or niobium (FeSi V and/or Nb) alloy having 15-80 wt % Si; 0.5-40 wt % V and/or Nb; up to 10 wt & Mo; up to 5 wt % Cr; up to 3 wt % Cu; up to 3 wt % Ni; up to 20 wt % Mg; 0.01 to 7 wt % Al; up to 13 wt % Ba; 0.01 to 7 wt % Ca; up to 13 wt % Mn; up to 8 wt & Zr; up to 12 wt & La and/or Ce and/or misch metal; up to 5 wt % Sr; up to 3 wt % Bi; up to 3 wt & Sb; up to 1.5 wt % Ti; balance Fe and incidental impurities; a method for the production of a FeSi V and/or Nb alloy and the use thereof in cast iron.

24 Claims, 4 Drawing Sheets

FERROSILICON VANADIUM AND/OR NIOBIUM ALLOY, PRODUCTION OF A FERROSILICON VANADIUM AND/OR NIOBIUM ALLOY, AND THE USE THEREOF

CROSS REFERENCE TO RELATED APPLICATION

This Application is a 371 of PCT/NO2022/050077 filed on Mar. 29, 2022 which, in turn, claimed the priority of Norwegian patent application No. 20210412 filed on Mar. 30, 2021, both applications are incorporated herein by reference.

TECHNICAL FIELD

The present invention relates to a ferrosilicon vanadium and/or niobium alloy, a method of production of a ferrosilicon vanadium and/or niobium alloy, and the use of such alloy. More specifically, the invention relates to a ferrosilicon vanadium and/or niobium alloy especially suitable as an additive in the manufacture of cast iron.

BACKGROUND ART

Vanadium and niobium metals are known as an additive to improve qualities of cast iron, such as higher strength, increased hardenability and higher wear resistance through precipitation carbides and nitrides in micron and nano-size, distributed in the structure upon solidification. The effect is referred to as precipitation strengthening; cf., review article by J. V. Dawson, UK International Exchange Paper, 1982. These small particles will contribute to so-called dislocation pinning, a metallurgical phenomenon that adds strength to the material when loaded to yielding. Microscopic carbide particles dispersed in solid metals often form coherency with the metal matrix structure, thus introducing lattice strain in the material. Lattice strain and dislocation pinning are both phenomena that contributes to obtain the desired strengthening effects. Vanadium and/or niobium is also a pearlite promoter in cast iron.

Vanadium is conventionally added to molten iron in the form of a ferrovanadium alloy, the most common is FeV80 (80% vanadium) but other grades like FeV60 (60% vanadium) or FeV50 can also be used. In addition to iron and vanadium, ferrovanadium alloys normally include small amounts of silicon, aluminium, carbon, sulfur, phosphorous, arsenic, copper, manganese, titanium, chromium and other impurities.

Niobium is conventionally added to molten iron in the form of a ferroniobium alloy, in various grades with niobium content range of 60-70%. Ferroniobium is produced aluminothermically from niobium pentoxide ($Nb_2O_5$) and iron oxide, which is used as is or purified by electron beam melting. Dependent on the grade, ferroniobium contains up to 3% silicon and 2.5% aluminium, as well as minor amounts of carbon, sulphur, phosphorous, manganese, titanium, etc.

The conventional ways to produce ferro vanadium alloys and ferroniobium alloys are by silicon reduction and by aluminium reduction. In both methods reduction is performed in a furnace, where vanadium oxide or niobium oxide is reduced either by reaction with silicon or with aluminium. The said production methods have the disadvantages of high consumption of energy to run the reaction and a relatively low vanadium yield or niobium yield as a significant amount of the vanadium oxide or niobium oxide ends up in the slag during the processing. Ferrovanadium and ferroniobium (the solidus temperatures are 1677° C. and 1503° C. for FeV80 and FeNb66, respectively) alloys have a relatively high melting temperature. Consequently, the alloys do not melt and need to dissolve. Dissolution times when added to an iron melt are long, which restricts the addition to these alloys to addition in heated furnaces and may lead to valuable vanadium unit or niobium unit that go into the slag, especially when smaller particle sizes are used, instead of the iron thus reducing the recovery and making it unstable. In addition, the iron melt needs to be superheated to make sure the alloy is dissolving, or hold on longer in the furnace before tapping which decreases the effectivity of the cast iron production. An additional disadvantage are the high densities of FeV80 and especially FeNb65. FeNb65 drops to the bottom of the furnace, which can lead to a segregation of niobium if the melt is not stirred enough.

Therefore, there is a desire for an improved vanadium and/or niobium additive for the production of cast iron. It is an object of the present invention to mitigate, alleviate or eliminate one or more of the above-identified disadvantages in the prior art.

SUMMARY OF THE INVENTION

According to a first aspect there is provided a ferrosilicon vanadium and/or niobium (FeSi V and/or Nb) alloy comprising 15-80 wt % Si; 0.5-40 wt % V and/or Nb; up to 10 wt % Mo; up to 5 wt % Cr; up to 3 wt % Cu; up to 3 wt % Ni; up to 20 wt % Mg; 0.01 to 7 wt % Al; up to 13 wt % Ba; 0.01 to 7 wt % Ca; up to 13 wt % Mn; up to 8 wt % Zr; up to 12 wt % La and/or Ce and/or misch metal; up to 5 wt % Sr; up to 3 wt % Bi; up to 3 wt % Sb; up to 1.5 wt % Ti; balance Fe and incidental impurities.

According to a first embodiment of the first aspect, the FeSi V and/or Nb alloy comprises 15-29 wt % Si; 0.5-40 wt % V and/or Nb; up to 10 wt % Mo; up to 5 wt % Cr; up to 3 wt % Cu; up to 3 wt % Ni; up to 20 wt % Mg; 0.01 to 7 wt % Al; up to 13 wt % Ba; 0.01 to 7 wt % Ca; up to 13 wt % Mn; up to 8 wt % Zr; up to 12 wt % La and/or Ce and/or misch metal; up to 5 wt % Sr; up to 3 wt % Bi; up to 3 wt % Sb; up to 1.5 wt % Ti; balance Fe and incidental impurities.

According to a second embodiment of the first aspect, the FeSi V and/or Nb alloy comprises from 30-50 wt % Si; from 16-40 wt % V and/or Nb; up to 10 wt % Mo; up to 5 wt % Cr; up to 3 wt % Cu; up to 3 wt % Ni; up to 20 wt % Mg; 0.01 to 7 wt % Al; up to 13 wt % Ba; 0.01 to 7 wt % Ca; up to 13 wt % Mn; up to 8 wt % Zr; up to 12 wt % La and/or Ce and/or misch metal; up to 5 wt % Sr; up to 3 wt % Bi; up to 3 wt % Sb; up to 1.5 wt % Ti; balance Fe and incidental impurities.

According to a third embodiment of the first aspect, the FeSi V and/or Nb alloy comprises from 51-80 wt % Si; 0.5-40 wt % V and/or Nb; up to 10 wt % Mo; up to 5 wt % Cr; up to 3 wt % Cu; up to 3 wt % Ni; up to 20 wt % Mg; 0.01 to 7 wt % Al; up to 13 wt % Ba; 0.01 to 7 wt % Ca; up to 13 wt % Mn; up to 8 wt % Zr; up to 12 wt % La and/or Ce and/or misch metal; up to 5 wt % Sr; up to 3 wt % Bi; up to 3 wt % Sb; up to 1.5 wt % Ti; balance Fe and incidental impurities.

According to an embodiment of said first and third embodiments of the first aspect, the FeSi V and/or Nb alloy comprises 5-35 wt % V and/or Nb.

The following embodiments are compatible with any of the above embodiments of the first aspect:

According to some embodiments, the FeSi V and/or Nb alloy comprises up to 15 wt %
Mg.

According to some embodiments, the FeSi V and/or Nb comprises up to 5 wt % Mo.

According to some embodiments, the FeSi V and/or Nb alloy has a melting temperature range 1060 to 1640° C.

According to some embodiments, the FeSi V and/or Nb alloy is in the form of particles or lumps having a sizing of between 0.06-50 mm.

According to some embodiments, the FeSi V and/or Nb particles or lumps are coated or mixed with bismuth oxide, and/or bismuth sulfide, and/or antimony sulfide, and/or antimony oxide, and/or other metal oxide like iron oxide, and/or another metal sulfide like iron sulphide.

According to some embodiments, the FeSi V and/or Nb alloy is an additive for use in the production of cast iron.

According to a second aspect there is provided a method for preparing a ferrosilicon vanadium and/or niobium (FeSi V and/or Nb) alloy according to the first aspect, and any of its embodiments, the method comprises:

providing a ferrosilicon alloy in molten state;

adding a vanadium oxide containing raw material and/or a niobium oxide containing raw material to the molten ferrosilicon alloy;

mixing and reacting the molten ferrosilicon alloy and vanadium oxide from the vanadium oxide containing raw material and/or niobium oxide from the niobium oxide containing raw material, thereby forming a melt of FeSi V and/or Nb alloy and slag;

separating the slag from the said melt; and solidifying or casting the molten FeSi V and/or Nb alloy.

According to some embodiments of the method, the molten ferrosilicon alloy is provided directly from a reduction furnace, wherein ferrosilicon is as-produced from raw materials according to conventional methods.

According to some embodiments of the method, the molten ferrosilicon alloy is provided by re-melting a charge of one or more ferrosilicon alloys According to some embodiments of the method, the vanadium oxide containing raw material and/or niobium oxide containing raw material is added in an amount (by weight) providing essentially the target amount of elemental vanadium and/or niobium (by weight) in the FeSi V and/or Nb alloy.

According to some embodiments of the method, the vanadium oxide containing raw material is one or more vanadium oxide phases selected from vanadium (II) oxide, vanadium (III) oxide, vanadium (IV) oxide, vanadium (V) oxide, and/or other non-principal oxides of vanadium.

According to some embodiments of the method, the niobium oxide containing raw material is one or more niobium oxide phases selected from niobium (II) oxide, niobium (III) oxide, niobium (IV) oxide, niobium (V) oxide, and/or other non-principal oxides of niobium.

According to some embodiments of the method, the vanadium oxide phase is vanadium (V) oxide, $V_2O_5$ and/or vanadium (III) oxide, $V_2O_3$.

According to some embodiments of the method, the niobium oxide phase is niobium (V) oxide, $Nb_2O_5$ and/or niobium (III) oxide, $Nb_2O_3$.

According to some embodiments of the method, the vanadium oxide containing raw material further comprises industrial waste material or ore comprising vanadium oxide.

According to some embodiments of the method, the niobium oxide containing raw material further comprises industrial waste material or ore comprising niobium oxide.

According to some embodiments of the method, a slag modifying compound is added to the molten ferrosilicon alloy in an amount of 0.5-30 wt %, based on the total amount of ferrosilicon alloy and vanadium oxide and/or niobium oxide.

According to some embodiments of the method, the slag modifying compound is at least one of CaO and MgO.

According to some embodiments of the method, the molten ferrosilicon alloy comprises:

40-90 wt % Si;
up to 0.5 wt % C;
0.01-7 wt % Al;
up to 6 wt % Ca;
up to 1.5 wt % Ti;
up to 15 wt % Mn;
up to 10 wt % Cr
up to 10 wt % Zr
up to 15 wt % Ba
up to 0.3 wt % P;
up to 0.5 wt % S;
the balance being Fe and incidental impurities.

According to some embodiments of the method, the method further comprises adding aluminium to the ferrosilicon melt, prior to, simultaneously, or after the addition of the vanadium oxide containing raw material and/or the niobium oxide containing raw material, in an amount of up to 10 wt %, based on the total amount of ferrosilicon and vanadium oxide and/or niobium oxide.

According to some embodiments of the method, the molten ferrosilicon alloy and the vanadium oxide containing raw material and/or the niobium oxide containing raw material, and any added aluminium and/or slag modifying compound, are mixed by mechanical stirring or gas stirring.

According to some embodiments of the method, the slag is separated before or during casting of the molten ferrosilicon vanadium and/or niobium alloy.

According to some embodiments of the method, the solidified casted ferrosilicon vanadium and/or niobium alloy is formed into blocks or crushed and optionally graded in size fractions or agglomerated.

According to a third aspect, there is provided a use of a ferrosilicon vanadium and/or niobium alloy, according to the first aspect, and any embodiments of the first aspect, as an additive in the manufacture of vanadium and/or niobium containing cast iron.

The present invention will become apparent from the detailed description given below. The detailed description and specific examples disclose preferred embodiments of the invention by way of illustration only. Those skilled in the art understand from guidance in the detailed description that changes and modifications may be made within the scope of the invention.

Hence, it is to be understood that the herein disclosed invention is not limited to the particular component parts of the device described or steps of the methods described since such device and method may vary. It is also to be understood that the terminology used herein is for purpose of describing particular embodiments only, and is not intended to be limiting. It should be noted that, as used in the specification and the appended claim, the articles "a", "an", "the", and "said" are intended to mean that there are one or more of the elements unless the context explicitly dictates otherwise. Thus, for example, reference to "a unit" or "the unit" may include several devices, and the like. Furthermore, the words "comprising", "including", "containing" and similar wordings does not exclude other elements or steps.

The term "incidental impurities" should be understood to denote minor amounts of impurity elements present in the ferrosilicon vanadium and/or niobium alloy or the ferrosilicon alloy.

The term "ferrosilicon alloy" (may also be denoted "ferrosilicon", "FeSi alloy" or simply "FeSi") in the present context should be understood to be a silicon based alloy containing iron, typically produced in a submerged arc furnace (SAF) by reduction of silica or sand with coke (or any other conventional carbonaceous material used as charge material) in the presence of iron or an iron source. Usual formulations on the marked are ferrosilicons with 15%, 45%, 65%, 75% and 90% (by weight) silicon. As-produced ferrosilicon alloys typically comprises about 2 wt % other elements, mainly aluminium and calcium, however, minor amounts of carbon, titanium, copper, manganese, phosphorous and sulphur are also common. The ferrosilicon alloy in the present context may also comprise for example manganese and/or chromium and/or zirconium and/or barium, as alloying elements or it can be a mix of for example ferrosilicon and ferrosilicon manganese and/or ferrosilicon chromium and/or ferrosilicon zirconium and/or ferrosilicon barium. In the present context, all such possible alloys will for simplicity be referred to as ferro silicon alloys (or "ferrosilicon" "FeSi alloy" or simply "FeSi) as indicated above.

The term "ferrosilicon vanadium and/or niobium alloy" (may also be denoted "FeSi V and/or Nb alloy" or simply "FeSi V and/or Nb") in the present context should be understood to be a ferrosilicon alloy comprising vanadium or niobium or comprising both vanadium and niobium. In addition to vanadium and/or niobium, the other elements as defined in the first aspect may also be present in the alloy.

The term "up to" when used in the indication of an amount of an element in the present context should be understood to mean that the element might be present in a range from 0 wt % and up to the indicated wt % value.

BRIEF DESCRIPTIONS OF THE DRAWINGS

DETAILED DESCRIPTION

Figure 1:
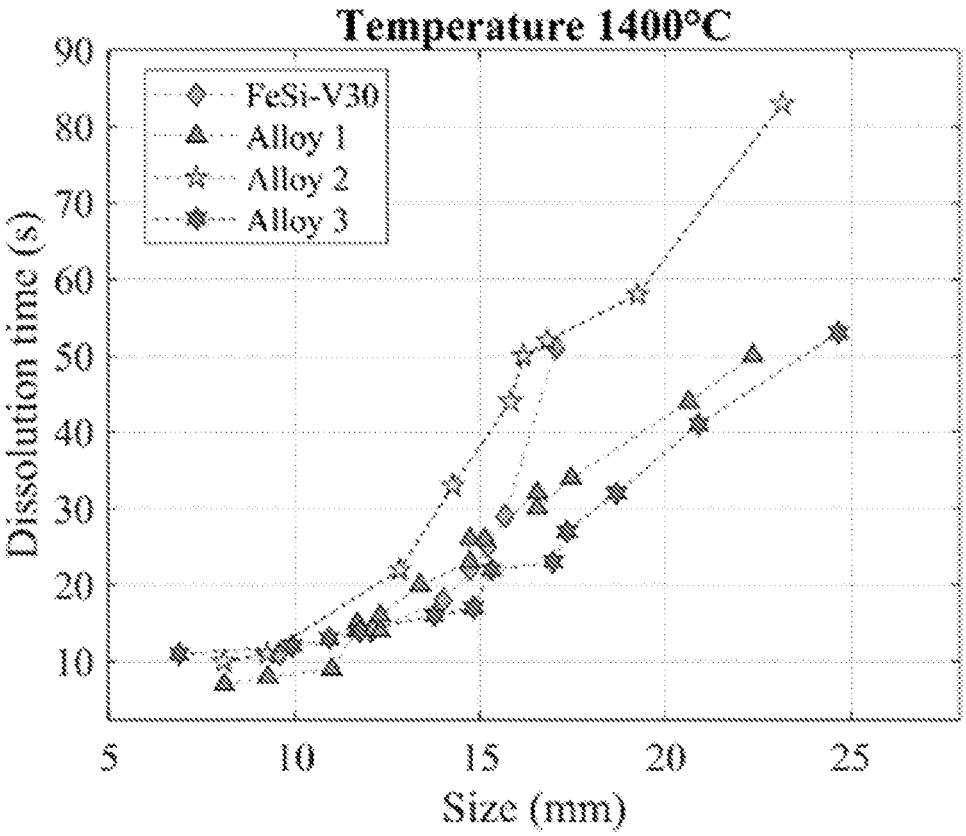
FIG. 1 is a diagram showing a comparison of dissolution time of different FeSiV alloys according to an embodiment of the present invention in a cast iron melt at 1400° C.

The ferrosilicon vanadium and/or niobium alloy according to the first aspect is especially suitable for use as an additive in cast iron production, for the production of vanadium and/or niobium containing cast iron. The first aspect of this invention relates to a FeSi V and/or Nb alloy comprising 15-80 wt % Silicon (Si); 0.5-40 wt % Vanadium (V) and/or Niobium (Nb); up to 10 wt % Molybdenum (Mo); up to 5 wt % Chromium (Cr); up to 3 wt % Cu; up to 3 wt % Ni; up to 20 wt % Magnesium (Mg); 0.01 to 7 wt % Aluminium (Al); up to 13 wt % Barium (Ba); 0.01 to 7 wt % Calcium (Ca); up to 13 wt % Manganese (Mn); up to 8 wt % Zirconium (Zr); up to 12 wt % Lanthanum (La) and/or Cerium (Ce) and/or misch metal; up to 5 wt % Strontium (Sr); up to 3 wt % Bismuth (Bi); up to 3 wt % Antimony (Sb); up to 1.5 wt % Titanium (Ti); balance iron (Fe) and incidental impurities.

The present FeSi V and/or Nb alloy is especially suitable as an additive in cast iron manufacturing.

Further, the FeSi V and/or Nb alloy according to the present invention has a lower melting temperature and a different dissolution route in molten cast iron compared with the conventional FeV80 or FeNb65 alloy. The potential lower melting temperature and different dissolution route lead to significantly higher dissolution rates in molten iron compared to FeV80 or FeNb65. The lower melting temperature and higher dissolution rate lead to reduced energy consumption when added to molten cast iron and result in better distribution of vanadium and/or niobium in the melt, which the lower densities of the alloys from the present invention might also improve. Furthermore, a higher dissolution rate means that the ferrosilicon vanadium and/or niobium additive alloy can be added later in the cast iron manufacturing process, which may lead a better flexibility of the process in the foundry.

Furthermore, the densities of the FeSi V and/or Nb alloy according to the present invention are lower than the densities of FeV80 and FeNb65. Added in the furnace or at the bottom of a ladle, their dissolution will not lead to segregation of V and Nb at the bottom. For example, added at the bottom of a ladle, the alloy pieces according to the present invention, which have a lower density than iron and will start to move upwards while dissolving. On the contrary, FeNb65 pieces for example would stay at the bottom of the ladle and dissolve there leading to a higher niobium concentration at the bottom.

Silicon is a common additive in the manufacture of cast iron. Silicon is an alloying element in cast iron ranging from 1 to 4.3 wt %. Silicon has an essential role in the production of cast iron (grey, compacted and ductile) and helps the nucleation of graphite rather than cementite. Silicon is also known to increase strength, wear resistance, elasticity and resistance to oxidation. The amount of Si in the present FeSi V and/or Nb alloy is between 15 and 80 wt %. In an embodiment, the amount of Si is at least 15 wt %; or at least 30 wt %; or at least 45 wt %; such as at least 51 wt % or at least 55 wt %. In an embodiment, the amount of Si is up to 75 wt %; such as up to 65 wt %; or up to 50 wt %; or up to 29 wt %.

The present FeSi V and/or Nb alloy comprises between 0.5 and 40 wt % V and/or Nb. This means that if only V is present it may be present in the range 0.5-40 wt %. If only Nb is present, it may be present in the range 0.5-40 wt %. If both V and Nb are present, the total amount of V and Nb in the alloy is in the range 0.5-40 wt %. If both V and Nb are present, they may be present in any ratio of V to Nb within the given range. In an embodiment, the amount of V and/or Nb is between 5-35 wt %. Vanadium and niobium form stable nitrides and carbides, resulting in a significant increase in the strength of cast iron. The strengthening of cast iron may also happen by pearlite promotion, refined pearlite lamella spacing or reined cell structures from the micro-alloying elements (V, Nb). Age hardening effect during annealing heat treatment (typically 1000-1100° C.), from primary carbide dissolution and re-precipitation of nano carbides upon cooling may also be obtained. Improved impact toughness, especially in un-notched samples, improved fatigue life properties in cyclic load applications of castings, improved wear resistance properties from carbide precipitates, especially in grey irons are other improvements that have been related to the use of V and Nb. Austempered ductile iron (ADI) is a heat treated material with excellent strength, wear and fatigue properties. In the production of ADI, alloying elements such as V and Nb are frequently applied to improve hardenability.

The V and/or Nb to Si range in the FeSiV alloy may depend on the amount of Si in the starting ferrosilicon alloy from which the FeSi V and/or Nb alloy is produced, e.g. a FeSi50 or FeSi65 alloy might provide a higher V and/or Nb to Si range compared to when starting from e.g. a FeSi75 alloy.

In some embodiments, the FeSi V and/or Nb alloy may comprise from 15 to 29 wt % Si, and from 0.5 to 40 wt % V and/or Nb, such as from 5-35 wt % V and/or Nb, or 9-30 wt % V and/or Nb, with the other elements as defined above according to the first aspect (up to 10 wt % Molybdenum (Mo); up to 5 wt % Chromium (Cr); up to 3 wt % Copper (Cu); up to 3 wt % Nickel (Ni); up to 20 wt % Magnesium (Mg); 0.01 to 7 wt % Aluminium (Al); up to 13 wt % Barium (Ba); 0.01 to 7 wt % Calcium (Ca); up to 13 wt % Manganese (Mn); up to 8 wt % Zirconium (Zr); up to 12 wt % Lanthanum (La) and/or Cerium (Ce), and/or misch metal; up to 5 wt % Strontium (Sr); up to 3 wt % Bismuth (Bi); up to 3 wt % Antimony (Sb); up to 1.5 wt % Titanium (Ti); balance Fe and incidental impurities).

In some embodiments, the FeSi V and/or Nb alloy may comprise from 30 to 50 wt % Si and 16-40, such as 16-35 wt % V and/or Nb, or 16-30 V and/or Nb, with the other elements as defined above according to the first aspect (up to 10 wt % Molybdenum (Mo); up to 5 wt % Chromium (Cr); up to 3% Copper (Cu); up to 3% Nickel (Ni); up to 20 wt % Magnesium (Mg); 0.01 to 7 wt % Aluminium (Al); up to 13 wt % Barium (Ba); 0.01 to 7 wt % Calcium (Ca); up to 13 wt % Manganese (Mn); up to 8 wt % Zirconium (Zr); up to 12 wt % Lanthanum (La) and/or Cerium (Ce) and/or misch metal; up to 5 wt % Strontium (Sr); up to 3 wt % Bismuth (Bi); up to 3 wt % Antimony (Sb); up to 1.5 wt % Titanium (Ti); balance Fe and incidental impurities).

In other embodiments, the FeSi V and/or Nb alloy may comprise from 51 to 80 wt % Si, such as 55-75 wt % Si, or 58-72 wt % Si, or 60-72 wt % Si, and from 0.5 to 40 wt % V and/or Nb, such as from 5-35 wt % V and/or Nb, or 9-30 wt % V and/or Nb, with the other elements as defined above according to the first aspect (up to 10 wt % Molybdenum (Mo); up to 5 wt % Chromium (Cr); up to 3 wt % Copper (Cu); up to 3 wt % Nickel (Ni); up to 20 wt % Magnesium (Mg); 0.01 to 7 wt % Aluminium (Al); up to 13 wt % Barium (Ba); 0.01 to 7 wt % Calcium (Ca); up to 13 wt % Manganese (Mn); up to 8 wt % Zirconium (Zr); up to 12 wt % Lanthanum (La) and/or Cerium (Ce), and/or misch metal; up to 5 wt % Strontium (Sr); up to 3 wt % Bismuth (Bi); up to 3 wt % Antimony (Sb); up to 1.5 wt % Titanium (Ti); balance Fe and incidental impurities).

It should be understood that several V and/or Nb to Si ranges can be realized within the above defined alloy compositions.

The FeSi V and/or Nb alloy comprises up to 10 wt % Mo. According to some embodiments, the FeSi V and/or Nb alloy comprises up to 5 wt % Mo, or up to 3 wt % Mo, or up to 1 wt % Mo. Molybdenum is also an alloying element often used in some grades of cast iron like austempered ductile iron (ADI). Molybdenum is providing hardenability and stabilizing structures for high temperature applications. In grey irons, molybdenum has been reported to increase tensile strength (by 20% at 0.5 wt % Mo in cast iron) and hardness (by 10% at 0.5 wt % in cast iron). Molybdenum refines pearlite.

The FeSi V and/or Nb alloy comprises up to 5 wt % Cr. According to some embodiments, the FeSi V and/or Nb alloy comprises up to 2 wt % Cr. Cr is an alloying element and has been reported to increase tensile strength and hardness. It is used together with vanadium and/or niobium in some cast iron grades.

The FeSi V and/or Nb alloy comprises up to 3 wt % Cu. According to some embodiments, the FeSi V and/or Nb alloy comprises up to 1 wt % Cu, or up to 0.5 wt % Cu. Copper can be used to counteract the strong eutectic iron carbide formation promoted by vanadium and/or niobium.

The FeSi V and/or Nb alloy comprises up to 3 wt % Ni. According to some embodiments, the FeSi V and/or Nb alloy comprises up to 1 wt % Ni, or up to 0.5 wt % Ni. Nickel can be used to counteract the strong eutectic iron carbide formation promoted by vanadium and/or niobium.

The following disclosure relating to the amounts of further elements Mg, Al, Ba, Ca, Mn, Zr, La, Ce, Sr, Bi, Sb, Ti, balance Fe and incidental impurities applies to each of the above mentioned embodiments, unless otherwise stated. These elements are commonly used in treatment alloys for the production of cast iron.

The FeSi V and/or Nb alloy comprises up to 20 wt % Mg. According to some embodiments, the FeSi V and/or Nb alloy comprises up to 15 wt % Mg, or up to 10 wt % Mg. In some embodiments, with low Si level, such as Si in the range 15-35 wt %, the alloy may be without any Mg present. Magnesium is mostly used in nodularising treatments to desulphurise and deoxidise the melt which will result in a change of the graphite form from flake to nodules. Magnesium can also be used in lower concentrations in inoculants. The solubility of magnesium in iron is limited, thus there is a lower limit of silicon content necessary in a ferrosilicon alloy to allow for magnesium alloying.

The FeSi V and/or Nb alloy comprises 0.01 to 7 wt % Al. According to some embodiments, the FeSi V and/or Nb alloy comprises from 0.01 to 5 wt % Al or from 0.05 to 5 wt % Al.

The FeSi V and/or Nb alloy comprises up to 13 wt % Ba. According to some embodiments, the FeSi V and/or Nb alloy comprises up to 11 wt % Ba, or up to 8 wt %, such as up to 6 wt % Ba. In some embodiments, the FeSi V and/or Nb may comprise 1-5 wt % Ba and 11-40 wt % V and/or Nb.

The FeSi V and/or Nb alloy comprises 0.01 to 7 wt % Ca. According to some embodiments, the FeSi V and/or Nb alloy comprises from 0.01 to 5 wt % Ca or from 0.05 to 5 wt % Ca.

The FeSi V and/or Nb alloy comprises up to 13 wt % Mn. According to some embodiments, the FeSi V and/or Nb alloy comprises up to 8 wt % Mn, or up to 5 wt % Mn. In some embodiments, the FeSi V and/or Nb may comprise up to 13 wt % Mn, up to 8 wt % or up to 5 wt % Mn and 10-40 wt % V and/or Nb.

The FeSi V and/or Nb alloy comprises up to 8 wt % Zr. According to some embodiments, the FeSi V and/or Nb alloy comprises up to 5 wt % Zr.

The FeSi V and/or Nb alloy comprises up to 12 wt % La and/or Ce, and/or misch metal. According to some embodiments, the FeSi V and/or Nb alloy comprises up to 7 wt % La and/or Ce, and/or misch metal. According to some embodiments, the FeSi V and/or Nb alloy comprises up to 4 wt % La and/or Ce, and/or misch metal. Mischmetal is an alloy of rare-earth elements, typically comprising approx. 50% Ce and 25% La, with small amounts of Nd and Pr. Lately heavier rare earth metals are often removed from the mischmetal, and the alloy composition of mischmetal may be about 65% Ce and about 35% La, and traces of heavier RE metals, such as Nd and Pr.

The FeSi V and/or Nb alloy comprises up to 5 wt % Sr. According to some embodiments, the FeSi V and/or Nb alloy comprises up to 3 wt % Sr.

The FeSi V and/or Nb alloy comprises up to 3 wt % Bi. According to some embodiments, the FeSi V and/or Nb alloy comprises up to 1.8 wt % Bi.

The FeSi V and/or Nb alloy comprises up to 3 wt % Sb. According to some embodiments, the FeSi V and/or Nb comprises up to 1.5 wt % Sb.

The FeSi V and/or Nb alloy comprises up to 1.5 wt % Ti. According to some embodiments, the FeSi V and/or Nb comprises up to 0.5 wt % Ti. Titanium is normally present in low amounts in the starting ferrosilicon alloy. Titanium may also come from the vanadium oxide raw material and/or niobium oxide raw material added during the production of the FeSi V and/or Nb alloy. Titanium is harmful in some cast iron grades as it can form hard carbides and nitrides that lead to brittleness and reduced fatigue stress. It also reduces the tolerance level for other subversive elements. Therefore, the content of Ti in FeSi V and/or Nb alloy is preferably low, such as up to 0.1 wt %, or up to 0.05 wt %.

The FeSi V and/or Nb alloy may comprise minor amounts of C, P and S. The said elements can be normally present in small amounts in as-produced ferrosilicon or be added via the vanadium oxide raw material and/or the niobium oxide raw material and/or slag modifying compound added during the production of the FeSi V and/or Nb alloy. The said elements in the indicated amounts will typically not be critical for cast iron production. Of the elements above it will be P which can be most problematic as it leads to formation of low melting steadite found in last to freeze areas. Steadite undergoes substantial contraction during solidification leading to shrinkage porosities and reduced strength.

The FeSi V and/or Nb alloy, according to any of the above said embodiments, is advantageously in the form of lumps. In the present context, the term "lumps" denotes particles or pieces of the FeSi V and/or Nb alloy, e.g. of crushed FeSi V and/or Nb metal. The FeSi V and/or Nb alloy lumps may be produced in different size grades. According to some embodiments, the FeSi V and/or Nb alloy is in the form of particles or lumps having a sizing of between 0.06-50 mm. Common sizings used within cast iron making are from about 0.2 mm to about 50 mm. The term sizing refers to the size of the holes in a sieve that a lump fits through. Thus, according to some embodiments, the FeSi V and/or Nb alloy is in the form of particles or lumps having a sizing of between 0.2-50 mm. It should be understood that the average size may vary within this given range and smaller and larger sizes of the FeSi V and/or Nb lumps are possible depending on applications. According to some embodiments, the FeSi V and/or Nb alloy is in the form of an insert, such as a cast block or an agglomeration of powder material.

According to some embodiments, the FeSi V and/or Nb particles can be coated or mixed with bismuth oxide, and/or bismuth sulfide, and/or antimony sulfide, and/or antimony oxide, and/or other metal oxide like iron oxide, and/or another metal sulfide like iron sulphide.

The FeSi V and/or Nb alloy, according to any of the above said embodiments, has a melting temperature range from about 1060 to about 1640° C., or to about 1610° C. The relatively low melting temperature and different dissolution route of the present FeSi V and/or Nb alloy in an iron melt has the effect that the FeSi V and/or Nb added to an iron melt dissolves relatively rapid. Tests performed by the inventors have shown that lumps of the present FeSi V (30 wt % V) having a size about 18 mm would be completely assimilated by the melt after 50 s at 1400° C. while a lump of FeV80 of the same size would still have not been assimilated at all after 3 min. The assimilation time for a 20 mm large lump would be twice as much for FeNb65 compared to FeSiNb20 at 1500° C.

FIG. 1 is a diagram showing dissolution time of different FeSi V alloys according to the present invention in an iron melt at a temperature of about 1400° C. The diagram shows dissolution time vs. different sizing of the FeSi V alloys. At this temperature, lumps of FeV80 of sizes between 7 and 18 mm were monitored for approximately 3 minutes but did not dissolve at all and are thus not represented in the plot.

Figure 2:
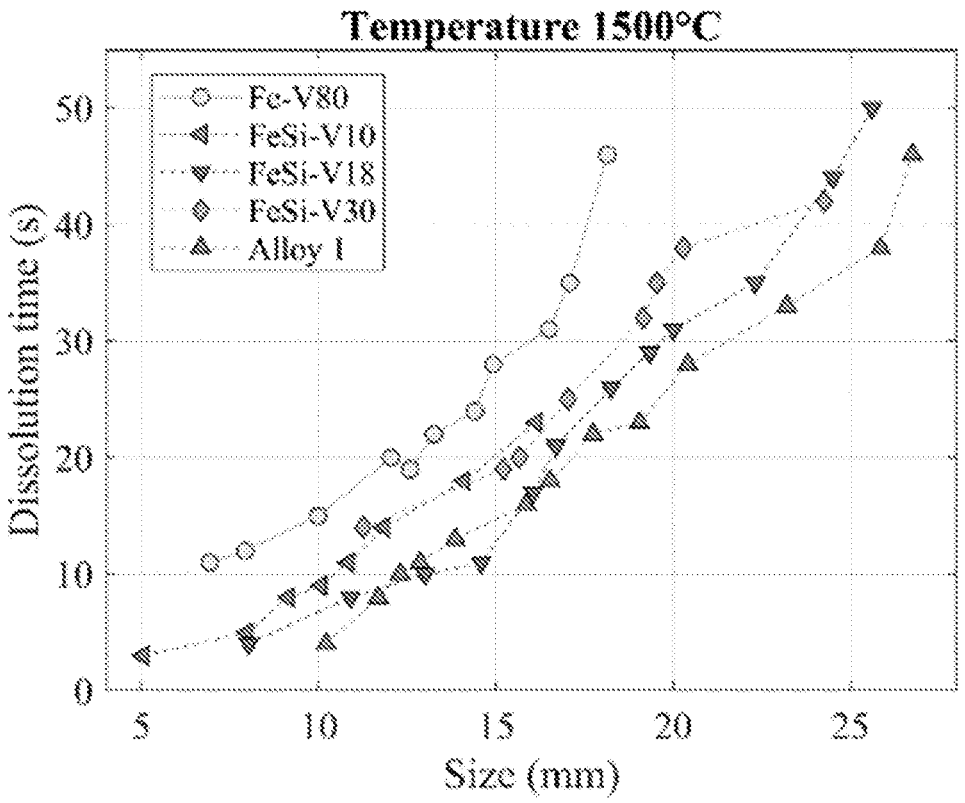
FIG. 2 is a diagram showing a comparison of dissolution time of different FeSiV alloys according to an embodiment of the present invention, and a standard FeV80 alloy in a cast iron melt at 1500° C.

FIG. 2 is a diagram showing dissolution time of different FeSi V alloys according to the present invention, compared to a standard commercial FeV80 alloy in an iron melt at a temperature of about 1500° C. The diagram shows dissolution time vs. different sizing of the FeSi V alloys and FeV80 lumps. The dissolution time of FeV80 alloy becomes significantly longer as the size of the lumps added to the iron melt increases, compared to the FeSi V alloys. Table 3 shows a significant higher yield of V for a FeSi V alloy compared to FeV80, both alloys having the same sizing when added to the melt.

Figure 3:
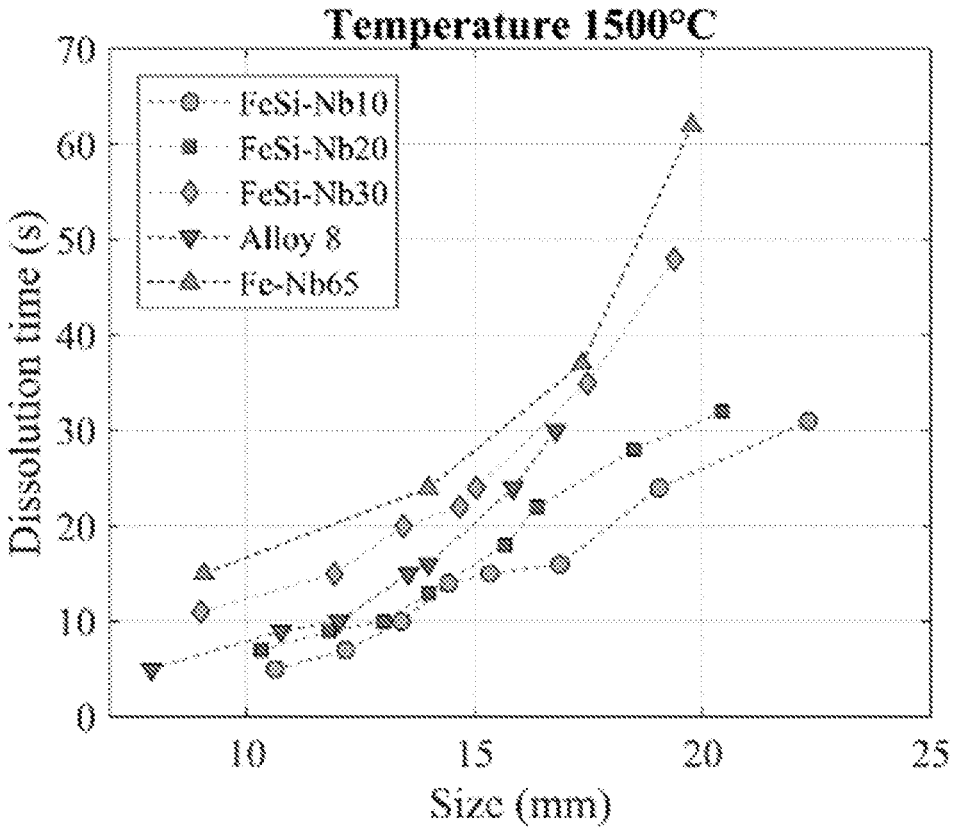
FIG. 3 is a diagram showing a comparison of dissolution time of different FeSiNb alloys according to an embodiment of the present invention, and a standard FeNb65 alloy in a cast iron melt at 1500° C.

FIG. 3 is a diagram showing dissolution time of different FeSi Nb alloys according to the present invention, compared to a standard commercial FeNb65 alloy in an iron melt at a temperature of about 1500° C. The diagram shows dissolution time vs. different sizing of the FeSi Nb alloys and FeNb65 lumps. The dissolution time of FeV80 alloy becomes significantly longer as the size of the lumps added to the iron melt increases, compared to the FeSi V alloys. Table 6 shows a significant higher yield of Nb for a FeSi Nb alloy compared to FeNb65, both alloys having the same sizing when added to the melt.

Figure 4:
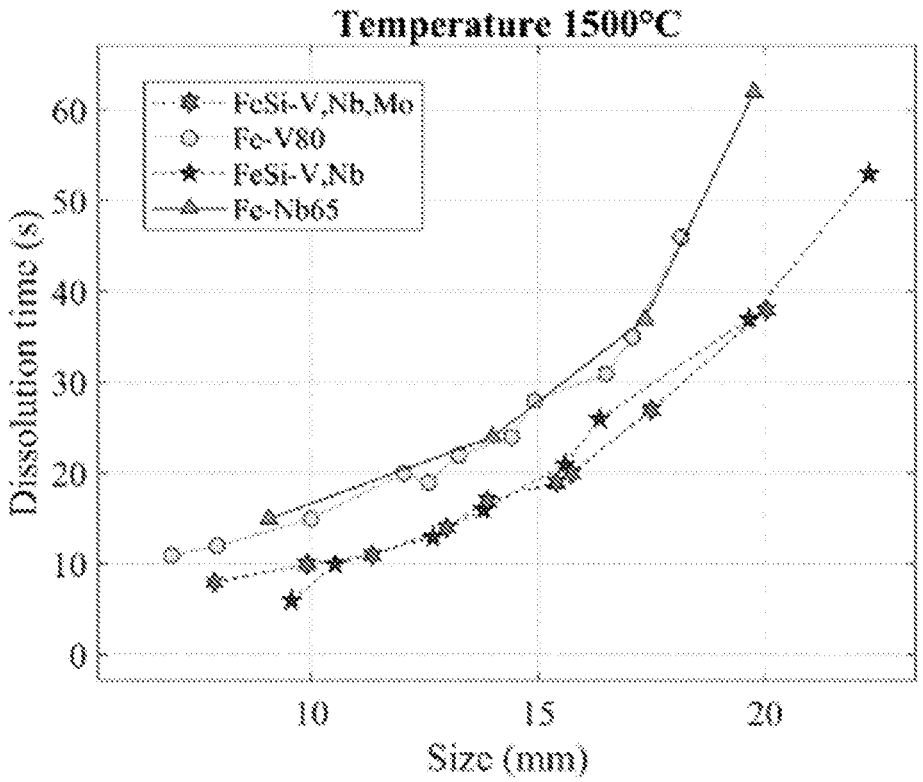
FIG. 4 is a diagram showing a comparison of dissolution time of FeSiNbV and FeSiNbVMo alloys according to an embodiment of the present invention, and a standard FeNb65 and a standard FeV80 alloy in a cast iron melt at 1500° C.

FIG. 4 is a diagram showing dissolution time of FeSi Nb V and FeSi Nb V Mo alloys according to the present invention, compared to standard commercial FeV80 and FeNb65 alloys in an iron melt at a temperature of about 1500° C. The diagram shows dissolution time vs. different sizing of the FeSi Nb V and FeSi Nb V Mo alloys and FeNb65 and FeV80 lumps. The dissolution time of FeV80 and FeNb65 alloys becomes significantly longer as the size of the lumps added to the iron melt increases, compared to the FeSi Nb V and FeSi Nb V Mo alloys.

The method for preparing the FeSi V and/or Nb alloy according to any of the above embodiments comprises: providing a ferrosilicon alloy in molten state; adding a vanadium oxide containing raw material and/or a niobium oxide containing raw material to the molten ferrosilicon alloy; mixing and reacting the molten ferrosilicon alloy and vanadium oxide from the vanadium oxide containing raw material and/or niobium oxide from the niobium oxide containing raw material, thereby forming a melt of FeSi V and/or Nb alloy and slag; separating the slag from the said melt of FeSi V and/or Nb alloy, optionally adjusting the composition of the elements according to the first aspect; and solidifying or casting the molten FeSi V and/or Nb alloy.

The following detailed description of the method of producing FeSi V and/or Nb alloy applies to any of the above-described embodiments of the FeSi V and/or Nb alloy according to the present invention.

The reaction between the molten ferrosilicon alloy and the vanadium oxide and/or the niobium oxide is fast allowing high productivity. The method for preparing the FeSi V and/or Nb alloy can be performed in a ladle, or in any similar suitable vessel such as a crucible or a melting pot including any kind of furnaces, to hold the molten ferrosilicon. Hence, there is no need of heating by supplying external energy such as using a furnace. The temperature of the ferrosilicon melt before addition of the vanadium oxide containing raw material and/or the niobium oxide containing raw material should be from about 1400 to about 1700° C. The present method for producing the FeSi V and/or Nb alloy leads to a high V and/or Nb-yield from the vanadium oxide (e.g. vanadium pentoxide) and/or niobium oxide (e.g. niobium oxide) into the FeSi V and/or Nb alloy, compared with conventional methods for producing ferrovanadium alloys, FeV and ferroniobium alloys, FeNb. Compared to conventional FeV and FeNb production, the present method is elegant and cost efficient.

The molten ferrosilicon alloy can be provided directly from a reduction furnace, typically a submerged arc furnace (SAF) wherein the ferrosilicon alloy is as-produced from raw materials according to conventional method or from an alloying station where the elements from the first aspect except for vanadium and/or niobium are alloyed in a ferrosilicon provided directly from a reduction furnace. Alternatively, the molten ferrosilicon alloy can be provided by remelting a charge of one or more ferrosilicon alloys, possibly refined or already alloyed with elements from the first aspect except for vanadium and/or niobium, or a combination of as-produced ferrosilicon alloy and a solidified ferrosilicon that is brought into molten state by any suitable heating means.

According to some embodiments of the method, the starting ferrosilicon alloy can be a mix of several ferrosilicon alloys with different compositions. For example, it can be a mix of ferrosilicon and ferrosilicon manganese or ferrosilicon chromium or ferrosilicon zirconium or ferrosilicon barium.

According to the method, the vanadium oxide containing raw material, e.g. $V_2O_5$, and/or niobium oxide containing raw material, e.g. $Nb_2O_5$ is added to the molten ferrosilicon alloy. The vanadium oxide containing raw material and/or the niobium oxide containing raw material may be added in an amount (by weight) providing essentially the target amount of elemental vanadium and/or niobium (by weight) in the FeSi V and/or Nb alloy. The method for adding the vanadium oxide containing raw material and/or the niobium oxide containing raw material is not critical, and may be performed in any convenient manner.

The vanadium oxide-containing raw material can be one or more vanadium oxide phases, such as vanadium (II) oxide, vanadium (III) oxide, vanadium (IV) oxide, vanadium (V) oxide, and/or other non-principal oxides of vanadium. The vanadium oxide is preferably vanadium (V) oxide ($V_2O_5$) and/or vanadium (III) oxide, $V_2O_3$, which are the most, used vanadium oxides in industrial applications. The vanadium oxide containing raw material may also comprise industrial waste materials or ores comprising vanadium oxide.

The niobium containing raw material can be one or more niobium oxide phases, such as niobium (II) oxide, niobium (III) oxide, niobium (IV) oxide, niobium (V) oxide, and/or other non-principal oxides of niobium. The niobium oxide is preferably niobium (V) oxide ($Nb_2O_5$) and/or niobium (III) oxide, $Nb_2O_3$, which are the most, used niobium oxides in industrial applications. The niobium oxide containing raw material may also comprise industrial waste materials or ores comprising niobium oxide.

The reduction reaction of the vanadium oxide and/or the niobium oxide leads to the formation of oxide compounds, generally denoted slags, mainly comprising aluminium oxide, silicon oxide and calcium oxide. A slag modifying compound can be added to the ferrosilicon melt to modify the slag formed during the reaction. The slag modifying compound can be CaO and/or MgO, and can be added in an amount of about 0.5-30 wt % of the final alloy, based on the total amount of ferrosilicon alloy. The necessary amount is based on the amount of vanadium oxide and/or niobium oxide to be added. The slag modifying compound can be added before or during the addition of the vanadium oxide containing raw material and/or the niobium oxide containing raw material. The slag composition is modified in a way to have a low viscosity and low melting slag to allow good slag/metal contact during the reduction reaction. Additionally, it can be modified for good metal/slag separation before casting. The slag, both produced during the reaction and added, will float on the melt, such that any formed waste and slag compounds formed during the reaction will accumulate in the layer of slag floating on the top of the melt.

The starting ferrosilicon alloy for the production of the FeSi V and/or Nb alloy should have a general composition of 40-90 wt % Si; up to 0.5 wt % C; 0.01-7 wt % Al; up to 6 wt % Ca; up to 1.5 wt % Ti; up to 15 wt % Mn; up to 10 wt % Cr; up to 10 wt % Zr; up to 15 wt % Ba; up to 0.3 wt % P; up to 0.5 wt % S; the balance being Fe and incidental impurities.

According to some embodiments of the method, the amount of Si in the starting ferrosilicon alloy is 70-80 wt %. According to some embodiments of the method, the amount of Si in the starting ferrosilicon alloy is 60-70 wt %. According to some embodiments of the method, the amount of Si in the starting ferrosilicon alloy is 40-55 wt %.

As-produced ferrosilicon alloys comprises small amounts of Al from the raw materials, typically in an amount of up to 1.5 wt %. The starting ferrosilicon alloy of the present invention may comprise up to 2 wt % Al; e.g, 0.01-2 wt % Al. When the vanadium oxide containing raw material and/or the niobium oxide containing raw material is added to the molten ferrosilicon alloy, the metallic Al present in the molten ferrosilicon reacts with the oxygen of the vanadium oxide and/or the niobium oxide reducing the vanadium and/or niobium, resulting in pure V and/or Nb and heat. Si in the molten ferrosilicon alloy will also react with the oxygen of the vanadium oxide and/or the niobium oxide, resulting in reduction of vanadium oxide to elemental V and/or niobium oxide to elemental Nb. Si is less reactive than Al in the present mixture, therefore, essentially all Al present in the ferrosilicon alloy will react with the oxygen of the vanadium oxide and/or the niobium oxide, resulting in a very low amount of aluminium in the produced FeSi V and/or Nb alloy. Calcium is also a common element in ferrosilicon alloys, generally in an amount of up to about 1.5 wt %. Ca present in the molten ferrosilicon alloy will also react with the oxygen of the vanadium oxide and/or the niobium oxide resulting in pure V and/or Nb and heat.

Additional aluminium can be added to the molten ferrosilicon alloy, to increase the amount of Al contained in the melt available for reducing the vanadium oxide and/or the niobium oxide. This may especially be relevant when producing FeSi V and/or Nb alloy with a high amount of vanadium and/or niobium, such as from FeSi V and/or Nb with a V and/or Nb amount of 10 wt % (FeSi V and/or Nb 10); up to FeSi V and/or Nb 20; up to up to FeSi V and/or Nb 30 or even up to FeSi V and/or Nb 40, while keeping the amount of silicon in the FeSi V and/or Nb alloy in the upper range. If additional aluminium is added to the ferrosilicon melt, the addition can be made before, during or after, preferably before or during, the addition of the vanadium oxide containing raw material and/or the niobium oxide containing raw material. Metallic aluminium may be added in an amount of up to about 10 wt %, or up to about 5 wt %, or up to about 1 wt %, based on the total amount of ferrosilicon and vanadium oxide and/or niobium oxide.

The molten ferrosilicon alloy is preferably stirred during the addition of the vanadium oxide containing raw material and/or the niobium oxide containing raw material, and any added aluminium and/or slag modifying compound, and during the reduction reaction in order to ensure contact of the V and/or Nb oxides and metal. The melt is conveniently stirred by mechanical stirring and/or gas stirring means generally known in the field.

The slag can be separated before or during casting of the molten ferrosilicon vanadium and/or niobium alloy. The FeSi V and/or Nb alloy is casted, and solidified according to generally known methods in the field. The solidified casted metal may be crushed and graded in size fractions adapted for different applications areas. The solidified casted FeSi V and/or Nb may also be agglomerated or in the form of blocks.

The present FeSi V and/or Nb alloy may be used as an additive in the production of vanadium and/or niobium containing cast iron.

According to some embodiments, the FeSi V and/or Nb alloy can be alloyed further with additional elements Mo, Cu, Cr, Ni, Mg, Al, Ba, Ca, Mn, Zr, La and/or Ce and/or misch metal, Sr, Bi, Sb according to standard procedures for the production of foundry additives.

According to some embodiments, foundry additives comprising up to 10 wt % Mo; up to 5 wt % Cr; up to 3 wt % Cu; up to 3 wt % Ni; up to 20 wt % Mg; 0.01 to 7 wt % Al; up to 13 wt % Ba; 0.01 to 7 wt % Ca; up to 13 wt % Mn; up to 8 wt % Zr; up to 12 wt % La and/or Ce and/or misch metal; up to 5 wt % Sr; up to 3 wt % Bi; up to 3 wt % Sb; up to 1.5 wt % Ti; balance Fe and incidental impurities, can also be used as a starting ferrosilicon alloy.

The granulated alloys can be packed or mixed with other alloys and packed in for example a cored wire. Alloyed with additional elements the ferrosilicon based vanadium and/or niobium alloy can be used as a preconditioner, as a cover material in a ladle nodularising treatment, as a nodulariser, as an inoculant either crushed, with or without a coating, or as an insert, such as a cast block or an agglomeration of powder material. Any type of ferrosilicon based vanadium and/or niobium alloy, further alloyed or coated with other elements, or not, can be used in cored wire.

A method for production of cast iron comprising adding a FeSi V and/or Nb alloy comprising 15-80 wt % Silicon (Si); 0.5-40 wt % Vanadium (V) and/or Niobium (Nb); up to 10 wt % Molybdenum (Mo); up to 5 wt % Cr; up to 3 wt % Cu; up to 3 wt % Ni; up to 20 wt % Magnesium (Mg); 0.01 to 7 wt % Aluminium (Al); up to 13 wt % Barium (Ba); 0.01 to 7 wt % Calcium (Ca); up to 12 wt % Manganese (Mn); up to 8 wt % Zirconium (Zr); up to 12 wt % Lanthanum (La) and/or Cerium (Ce), and/or misch metal; up to 5 wt % Strontium (Sr); up to 3 wt % Bismuth (Bi); up to 3 wt % Antimony (Sb); up to 1.5 wt % Ti; balance Fe and incidental impurities. The said method for production of cast iron, comprising adding a FeSi V and/or Nb alloy according to any above-described embodiments.

It was surprisingly found that an alloy based on ferrosilicon and containing vanadium and/or niobium had a much faster assimilation of vanadium and/or niobium by the iron melt which allows the use of such an alloy further down in the cast iron process as the melting point is potentially lower and the dissolution route different with a higher recovery of vanadium and/or niobium than in prior art solutions. An advantage of being able to add vanadium and/or niobium after tapping from the furnace is the possibility to treat less iron allowing easier transition between grades, avoid overheating of the iron melt and contamination of the lining in the furnace, even having a high flexibility as to the batch size in alloyed cast iron pieces if added as an element in an inoculant in-stream.

The possible uses of an alloy based on ferrosilicon and containing vanadium and/or niobium are as FeSi V or FeSi Nb V or FeSi Nb and incidental impurities as part of the charge in the furnace or in an holding furnace without the need of long waiting time nor increased temperature over what is necessary for the foundry process downstream, or added further down in the process. When alloyed with additional elements the ferrosilicon based vanadium and/or niobium alloy can also be used to alloy the melt in a furnace, be used as a preconditioner, as a cover material or as nodulariser in a ladle treatment, as an inoculant either crushed, with or without a coating, or as an insert. Any type of ferrosilicon based vanadium and/or niobium alloy, further alloyed or coated with other elements, or not, can be used in cored wire mixed or not with other alloys or elements.

Another advantage of such an alloy is the lower density compared to FeV80 or FeNb65. Indeed an alloy with a high density will have a tendency to drop to the bottom of a furnace or a ladle and lead to a segregation in the iron melt if not stirred properly.

Another advantage of such an alloy is to have one less addition step in the process when the addition of vanadium and/or niobium is combined with the addition of other necessary treatment alloys.

EXAMPLES

Example 1. Production of the Ferrosilicon Containing Vanadium Alloys

Ten melts for the production of FeSi V alloys according to the present invention were prepared. Two categories of alloys were produced. The first category are ferrosilicon vanadium alloys, the second category alloys are a combination of the advantages of ferrosilicon vanadium alloys with the addition of some of the elements commonly used to treat cast iron melts, both categories are according to the present invention. FeSi V was produced as described in this text using vanadium oxide. For the other alloys, the other elements were added to FeSi V. It was done in two steps; a larger batch of FeSi V was produced and then cast and coarsely crushed, then remelted for the addition of the other elements in smaller batches.

The following table 1 shows raw material amounts of FeSi75 (lumpy) and $V_2O_5$ (powder) for three test productions of FeSi V. Additionally, lime (CaO) amounts to modify the slag and the total Al in the system are given. The temperature (T) was set to be above the melting point of FeSi V alloy before $V_2O_5$ addition. The molten ferrosilicon alloy was stirred during addition of $V_2O_5$, lime and any aluminium. The produced composition is given in the right part of the table. During tapping it is important for the purity of the produced FeSi V alloy to separate slag and metal.

TABLE 1

Production of FeSi V alloy

| | Additions (kg) | | | | | Analyses (wt %) | | | | | |
|---|---|---|---|---|---|---|---|---|---|---|---|
| Melt | FeSi | $V_2O_5$ | CaO | Al | T (° C.) | Si | V | Fe | Al | Ca | Alloy ID |
| 1 | 10.0 | 1.84 | 1.00 | 0.01 | 1565 | 67.1 | 9.4 | 22.8 | 0.020 | <0.1 | |
| 2 | 7.94 | 1.46 | 0.80 | 0.11 | 1588 | 68.5 | 10.4 | 21.6 | 0.035 | <0.1 | |
| 3 | 10.0 | 3.78 | 2.00 | 0.28 | 1585 | 58.7 | 19.2 | 21.4 | 0.024 | <0.1 | |
| 4 | 10.0 | 1.83 | 1.00 | 0.06 | 1620 | 67.0 | 9.7 | 22.8 | 0.015 | <0.1 | FeSiV10 |
| 5 | 10.0 | 3.77 | 2.0 | 0.0 | 1620 | 58.3 | 18.1 | 21.5 | 0.2 | <0.1 | FeSiV18 |
| 6 | 8.8 | 5.3 | 2.8 | 0.2 | 1630 | 49.7 | 29.5 | 17.8 | 0.3 | 0.9 | FeSiV30** |

*Al added includes Al from FeSi and Al added separately.
**The FeSiV30 alloy contains also 1.5 wt % Cr.

The following table 2 shows the composition of the ferrosilicon alloys containing vanadium with additional commonly used elements for cast iron melt treatment. A ferrosilicon vanadium alloy was first produced according to the method described above, then different elements were alloyed in the melt and these resulting ferrosilicon vanadium alloys according to the invention are denoted "alloys" for simplicity reasons.

TABLE 2

Chemical analysis of the V-containing ferrosilicon alloys produced

| wt % | Alloy 1 | Alloy 2 | Alloy 3 | Alloy 4 |
|---|---|---|---|---|
| Si | 56.6 | 57.4 | 55.1 | 55.1 |
| V | 15.7 | 16.4 | 16.7 | 17.1 |
| Mg | <0.1 | 0.12 | <0.1 | 3.8 |
| Al | 0.76 | 1.14 | 1.15 | 0.47 |
| Ba | 1.43 | <0.5 | <0.5 | <0.5 |
| Ca | 0.65 | 1.92 | 1 | 0.62 |
| Zr | <0.1 | 2.62 | <0.1 | <0.1 |
| La | <0.1 | <0.1 | <0.1 | 0.6 |
| Ce | 0.4 | 0.1 | 1.7 | 0.1 |
| Bi | <0.1 | 0.1 | <0.1 | <0.1 |

Example 2. Comparison of Dissolution Behavior of FeSi V Alloys Vs. FeV80

The dissolution behavior of FeSi V alloys was compared to the dissolution behavior of FeV80 in molten iron at a temperature of 1400° C. and 1500° C. The carbon and silicon concentrations in the iron melt were 3.6 wt % and 2.2 wt %, respectively. The dissolution time can be measured with different techniques known from literature. Examples would be connecting a load cell to the ferroalloy and measuring the loss in weight [Gourtsoyannis et al., 1984] or taking samples of the cast iron melt in fixed intervals and analyzing the element content [Argyropoulus, 1983]. The methods in the references are described for the measurement of dissolution time in steel; the same principle can be applied for measuring the dissolution time in an iron melt.

Reference is made to FIG. 1 showing dissolution time at 1400° C. At 1400° C., pieces of FeV80 of sizes between 7 and 18 mm were monitored for approximately 3 minutes but did not dissolve at all and are thus not represented in the plot. Thus, the dissolution time of FeSi V alloys is much lower than the one for FeV80.

Reference is made to FIG. 2 where it is seen that the measured dissolution time for FeV80 was 2 times longer for lumps up to 20 mm than dissolution time of FeSiV18 (FeSi V with about 18 wt % V). For bigger sizes of the lumps, the difference would be even higher. 1500° C. is a standard tapping temperature from the furnace and all processes after tapping would be at lower temperature and between 1300° C. and 1400° C. for the inoculation step.

Example 3. Vanadium Yield

FeSi V alloys were used in the inoculation step during the production of cast iron. The melt was heated in an induction over, treated with a nodulariser before it was poured into six pouring ladles. Prior to pouring, the alloys were added to the bottom of the pouring ladles. All the alloys were crushed to the same size 1-3 mm. The quantity of iron poured in each ladle was the same. The temperature of the iron in the nodulariser ladle just prior to pouring in the pouring ladles was 1424° C. The melt was hold in the pouring ladles for 1 and 5 min then cast into a sand mould. Prior to pouring, a coin was taken for chemical analysis in an ArcSpark-OES spectrometer.

As can be seen in Table 3, the FeSi V alloys were completely assimilated into the melt after 1 min with a full recovery of vanadium, while the recovery of vanadium from FeV80 was only 63% after 5 min.

TABLE 3

Vanadium yield

| | | | Holding time: 1 min | | Holding time: 5 min | |
|---|---|---|---|---|---|---|
| Ladle | Alloy | V addition in wt % | V in final iron (wt %) | Yield % | V in final iron (wt %) | Yield % |
| 1 | FeV 80 | 0.120 | No sample | | 0.080 | 63 |
| 2 | FeSiV 18 | 0.128 | 0.134 | 102* | 0.136 | 103* |
| 3 | Alloy 1 | 0.120 | 0.133 | 108* | 0.133 | 107* |
| 4 | Alloy 2 | 0.116 | 0.128 | 106* | 0.126 | 104* |
| 5 | Alloy 4 | 0.128 | 0.125 | 94 | 0.125 | 94 |
| 6 | FeV 80 | 0.120 | 0.056 | 43 | 0.080 | 63 |

*Values over 100% due to a small variation of the amount of iron poured compared to the target.

Example 4. Production of the Ferrosilicon Containing Niobium Alloys

Eight melts for the production of FeSi Nb alloys according to the present invention were prepared. Two categories of alloys were produced. The first category are ferrosilicon niobium alloys, the second category alloys are a combination of the advantages of ferrosilicon niobium alloys with the addition of some of the elements commonly used to treat cast iron melts, both categories are according to the present invention. FeSi Nb was produced as described in this text using niobium oxide. For the other alloys, the other elements were added to FeSi Nb. It was done in two steps, a larger batch of FeSi Nb was produced and then cast and coarsely crushed, then remelted for the addition of the other elements in smaller batches.

The following table 4 shows raw material amounts of FeSi75 and $Nb_2O_5$ (in fine powder form) for three test productions of FeSi Nb. Additionally, lime (CaO) amounts to modify the slag and the total Al in the system are given. The temperature (T) was set to be above the melting point of FeSi Nb alloy before $Nb_2O_5$ addition. The molten ferrosilicon alloy was stirred during addition of $Nb_2O_5$, lime and any aluminium. The produced composition is given in the right part of the table. During tapping it is important for the purity of the produced FeSi Nb alloy to separate slag and metal.

TABLE 4

Production of FeSi Nb alloy

| | Additions (kg) | | | | | Analyses (wt %) | | | | | |
|---|---|---|---|---|---|---|---|---|---|---|---|
| Melt | FeSi | $N_2O_5$ | Lime, | Al added* | T (° C.) | Si | Nb | Fe | Al | Ca | Name |
| 1 | 9 | 1.41 | 0.57 | 0.22 | 1600 | 70 | 8.9 | 21 | 0.25 | 0.08 | FeSiNb10 |
| 2 | 9 | 3.09 | 1.23 | 0.47 | 1650 | 58 | 19.0 | 22 | 0.29 | 0.13 | FeSiNb20 |
| 3 | 9 | 5.12 | 2.04 | 0.78 | 1700 | 47 | 31.9 | 21 | 0.35 | 0.11 | FeSiNb30 |

*Al added includes Al from FeSi and Al added separately

The following table 5 shows the composition of the ferrosilicon alloys containing niobium with additional commonly used elements for cast iron melt treatment. A ferrosilicon niobium alloy with target Nb level of 30 wt % was first produced according to the method described above, then different elements were alloyed in the melt and these resulting ferrosilicon niobium alloys according to the invention are denoted "alloys" for simplicity reasons.

TABLE 5

Chemical analysis of the Nb-containing ferrosilicon alloys produced.

| wt % | Alloy 5 | Alloy 6 | Alloy 7 | Alloy 8 | Alloy 9 |
|---|---|---|---|---|---|
| Si | 48.8 | 49.5 | 51.5 | 48.5 | 47.4 |
| Nb | 28.5 | 23.7 | 26.0 | 29.3 | 27.2 |
| Al | 0.93 | 3.7 | 1.9 | 1.6 | 4.71 |
| Ba | <0.5 | <0.5 | <0.5 | 0.18 | <0.5 |
| Ca | 1.7 | 2.3 | 2.7 | 1.9 | 1.35 |
| Zr | <0.05 | 3.2 | <0.05 | 0.16 | 0.97 |
| La | <0.1 | <0.1 | <0.1 | <0.1 | <0.1 |
| Ce | <0.05 | <0.05 | <0.05 | <0.05 | <0.05 |
| Sr | 1.2 | <0.02 | <0.02 | <0.02 | 1.27 |
| Ti | <0.5 | <0.5 | <0.5 | 0.9 | <0.5 |

Example 5. Comparison of Dissolution Behavior of FeSi Nb Alloys Vs. FeNb65

The dissolution behavior of FeSi Nb alloys was compared to the dissolution behavior of FeNb65 in molten iron at a temperature of 1500° C. The carbon and silicon concentrations in the iron melt were 3.6 wt % and 2.2 wt %, respectively.

As can be seen in FIG. 3, the dissolution time of the FeSi Nb alloys is shorter than the one of FeNb65. 1500° C. is a standard tapping temperature from the furnace and all processes after tapping would be at lower temperature and between 1300° C. and 1400° C. for the inoculation step. At lower temperature, the higher dissolution time of FeNb65 between the different alloys would be even clearer.

Example 6. Niobium Yield

Nb is normally added to cast iron by FeNb by addition to the furnace due to the high melting point. The purpose of having Nb as part of a FeSi alloy is to have an alloy with lower melting point, which could facilitate addition later in the process. This was tested out by adding Nb-containing alloys in the inoculation step during production of cast iron. The addition rate of the different Nb-containing alloys was adjusted to deliver the same amount of Nb to the iron, in this case 0.20 wt %. The trial was also done at two temperatures; 1500° C. and 1440° ° C. to check that the yield was not a problem at lower temperatures. A tapping temperature of 1500° C. means a peak temperature of around 1420° C. for dissolution of the Nb-containing alloys, while a tapping temperature of 1440° C. means a peak temperature of around 1350° C. for dissolution of the Nb-containing alloys. The alloys were added in the bottom of pouring ladles and hold for 1 min before casting. Sizing of the alloys was the same for all pouring ladles in both trials, 1-3 mm.

The trial set up for testing with tapping temperature of 1500° C. can be seen in table 6 below.

TABLE 6

Trial set up for testing out Nb-yield with tapping temperature of 1500° C.

| HV1 | Alloy | wt % Nb in alloy | Addition | Target wt % Nb | Actual wt % Nb | Yield Nb % |
|---|---|---|---|---|---|---|
| 11 | FeNb | ≈65 | 0.3 wt %-60 g | 0.2 | 0.027 | 8 |
| 12 | FeSiNb20 | 19 | 1.0 wt %-200 g | 0.19 | 0.164 | 81 |
| 13 | FeSiNb30 | 31 | 0.63 wt %-126 g | 0.2 | 0.176 | 83 |
| 14 | Alloy 8 | 29 | 0.88 wt %-176 g | 0.26 | 0.219 | 80 |
| 15 | Alloy 6 | 24 | 0.78 wt %-156 g | 0.18 | 0.182 | 95 |
| 16 | Alloy 5 | 29 | 0.80 w t%-160 g | 0.26 | 0.219 | 80 |

The trial was repeated for FeNb, FeSiNb30 and Alloy 8 with a lower tapping temperature; 1440° C. and the trial set is shown in table 7 below.

TABLE 7

Trial set up for testing out Nb-yield with tapping temperature of 1440° C.

| HV2 | Alloy | wt % Nb | Addition | Target wt % Nb | Actual wt % Nb | Yield Nb % |
|---|---|---|---|---|---|---|
| 21 | FeNb | ≈65 | 0.30 wt %-60 g | 0.2 | 0.042 | 16% |
| 22 | Alloy 8 | 29 | 0.88 wt %-176 g | 0.26 | 0.211 | 77% |
| 23 | FeSiNb30 | 30 | 0.63 wt %-126 g | 0.2 | 0.145 | 69% |

As can be seen from the results in table 6 and 7 a considerable higher yield for Nb was achieved with the FeSi alloys with Nb compared to the FeNb alloy. For the FeSi-based Nb-containing alloys, an Nb-yield above 80% is achieved at the tapping temperature of 1500° C. while only a yield of 8% is achieved with FeNb. At the lower tapping temperature of 1440° C. the Nb-yield of the FeSi alloys with Nb decreases to around 70% while the Nb-yield of 16% is observed with FeNb.

Example 7. Production of the Ferrosilicon Containing Niobium and Vanadium Alloys, and Niobium, Vanadium and Molybdenum Alloys One melt for the production of FeSi V Nb alloy according to the present invention was prepared. The following table 8 shows raw material amounts of FeSi75, $V_2O_5$ and $Nb_2O_5$.

Additionally, lime (CaO) amounts to modify the slag and the total Al in the system are given. The temperature (T) was set to be above the melting point of FeSi V Nb alloy before $V_2O_5$ and $Nb_2O_5$ addition. The molten ferrosilicon alloy was stirred during addition of $V_2O_5$, $Nb_2O_5$, lime and any aluminium. The produced composition is given in the right part of the table. During tapping, it is important for the purity of the produced FeSi V Nb alloy to separate slag and metal.

An additional alloy was made by adding FeMo65 in addition to vanadium and niobium oxide to obtain a FeSi V Nb Mo alloy. FeMo65 has 65 wt % Mo. The raw material amounts used for the production and the composition of the FeSi V Nb Mo alloy are shown in Table 9.

Example 8. Comparison of Dissolution Behavior of FeSi Nb V and FeSi Nb V Mo Alloys Vs. FeNb65 and FeV80

The dissolution behavior of FeSi Nb V and FeSi Nb V Mo alloys was compared to the dissolution behavior of FeNb65 and FeSiV80 in a bath of iron at a temperature of 1500° C. The carbon and silicon concentrations in the iron melt were 3.6 wt % and 2.2 wt %, respectively. With reference to FIG. 4, it is obvious that the dissolution times of the FeSi Nb V and FeSi Nb V Mo are lower than the ones for FeV80 and FeNb65.

Example 9. Production of FeSi V from FeSiCr/FeSiMn

Starting from FeSi alloys comprising Mn and Cr as alloying elements with Mn or Cr content of 5 wt %, will result in FeSi V alloys with compositions as indicated in table 10 below.

TABLE 10

Amounts FeSiMn/FeSiCr, vanadium oxide, lime and resulting alloy compositions from adding $V_2O_5$ into FeSiMn or FeSiCr.

| Additions | | | | | | | | Resulting alloy (wt %) | | | | | |
|---|---|---|---|---|---|---|---|---|---|---|---|---|---|
| FeSiCr/FeSiMn alloy | | | | | | | | | | | | | |
| Si wt % | Fe wt % | Mn wt % | Cr wt % | kg | Lime kg | $V_2O_5$ kg | Kg | % Si | % V | % Fe | % Mn | % Cr |
| 70 | 25 | 5 | 0 | 9.7 | 1 | 1.8 | 10 | 60.9 | 10 | 24 | 4.8 | 0.0 |
| 70 | 25 | 5 | 0 | 9.4 | 2 | 3.6 | 10 | 51.9 | 20 | 23 | 4.7 | 0.0 |
| 69 | 26 | 0 | 5 | 9.7 | 1 | 1.8 | 10 | 60.9 | 10 | 24 | 0.0 | 4.8 |
| 69 | 26 | 0 | 5 | 9.4 | 2 | 3.6 | 10 | 51.9 | 20 | 23 | 0.0 | 4.7 |

A further trial for the production of FeSi V alloys according to the present invention using FeSiMn as a raw material was prepared. The following table 11 shows raw material amounts of FeSiMn and $V_2O_5$ for two test productions of FeSi V. Additionally, lime (CaO) amounts to modify the slag

TABLE 8

Production and composition of FeSi V Nb alloy

| | Additions (kg) | | | | | | Analyses (wt %) | | | | | |
|---|---|---|---|---|---|---|---|---|---|---|---|---|
| Melt | FeSi | $V_2O_5$ | $N_2O_5$ | Lime | Al added* | T (° C.) | Si | V | Nb | Fe | Al | Ca |
| 1 | 9.0 | 1.93 | 1.51 | 1.68 | 0.44 | 1700 | 57.0 | 8.8 | 10.6 | 23.4 | 0.12 | 0.03 |

TABLE 9

Production and composition of FeSi V Nb Mo alloy

| | Additions (kg) | | | | | | | Analyses (wt %) | | | | | | |
|---|---|---|---|---|---|---|---|---|---|---|---|---|---|---|
| Melt | FeSi | $V_2O_5$ | $N_2O_5$ | Lime | Al | FeMo 65 | T (° C.) | Si | V | Nb | Mo | Fe | Al | Ca |
| 1 | 9.0 | 1.93 | 1.51 | 1.68 | 0.44 | 0.77 | 1700 | 54.2 | 8.4 | 10.1 | 4.8 | 22.2 | 0.11 | 0.03 |

and the total Al in the system are given. The molten alloy was stirred during addition of $V_2O_5$, lime and any aluminium. The produced composition is given in the right part of table 11.

TABLE 11

Amounts of FeSiMn, lime, aluminum, $V_2O_5$. Analyses of produced alloy compositions.

| Additions | | | | | | | | | Analyses | | | | |
|---|---|---|---|---|---|---|---|---|---|---|---|---|---|
| FeSiCr/FeSiMn alloy | | | | | | | | | | | | | |
| Si wt % | Fe wt % | Mn wt % | Cr wt % | kg | Lime kg | $V_2O_5$ kg | Al kg | T (° C.) | Si wt % | V wt % | Fe wt % | Mn wt % | Cr wt % |
| 63 | 21 | 14 | — | 9.7 | 1.0 | 1.8 | 0.1 | 1600 | 56 | 10 | 19 | 13 | — |

Example 10. Density Measurement of Selected Alloys

Table 12 shows the measured densities for selected alloys. As it can be seen from the table, the densities of the FeSi V Nb alloys according to the invention are considerably lower than the densities of FeV80 and FeNb65.

TABLE 12

Alloy densities

| Material | Density (g/cm$^3$) |
|---|---|
| FeV80 | 6.02 |
| FeSi V10 | 3.43 |
| FeSi V18 | 3.87 |
| FeSi V30 | 4.55 |
| Alloy 1 | 3.76 |
| Alloy 2 | 3.79 |
| Alloy 4 | 3.07 |
| FeNb65 | 7.84 |
| FeSi Nb10 | 3.33 |
| FeSi Nb20 | 3.64 |
| FeSi Nb30 | 4.12 |
| FeSi V Nb | 4.11 |
| FeSi V Nb Mo | 4.33 |
| Alloy 8 | 4.02 |

The person skilled in the art realizes that the present invention is not limited to the preferred embodiments described above. The person skilled in the art further realizes that modifications and variations are possible within the scope of the appended claims. Additionally, variations to the disclosed embodiments can be understood and effected by the skilled person in practicing the claimed invention, from a study the disclosure, and the appended claims.

The invention claimed is:

1. A ferrosilicon vanadium and/or niobium (FeSi V and/or Nb) alloy, comprising 15-80 wt % Si;
5-35 wt % V and/or Nb;
up to 10 wt % Mo;
up to 5 wt % Cr;
up to 3 wt % Cu;
up to 3 wt % Ni;
up to 20 wt % Mg;
0.01-7 wt % Al;
up to 13 wt % Ba;
0.01-7 wt % Ca;
up to 13 wt % Mn;
up to 8 wt % Zr;
up to 4 wt % La and/or Ce and/or misch metal;
up to 5 wt % Sr;
up to 3 wt % Bi;
up to 3 wt % Sb;
up to 0.5 wt % Ti;
balance Fe and incidental impurities.

2. The FeSi V and/or Nb alloy according to claim 1, wherein the FeSi V and/or Nb alloy comprises 15-29 wt % Si; 5-35 wt % V and/or Nb; up to 10 wt % Mo; up to 5 wt % Cr; up to 3 wt % Cu; up to 3 wt % Ni; up to 20 wt % Mg; 0.01 to 7 wt % Al; up to 13 wt % Ba; 0.01 to 7 wt % Ca; up to 13 wt % Mn; up to 8 wt % Zr; up to 4 wt % La and/or Ce and/or misch metal; up to 5 wt % Sr; up to 3 wt % Bi; up to 3 wt % Sb; up to 0.5 wt % Ti; balance Fe and incidental impurities.

3. The FeSi V and/or Nb alloy according to claim 1, wherein the FeSi V and/or Nb alloy comprises from 30-50 wt % Si; from 16-35 wt % V and/or Nb; up to 10 wt % Mo; up to 5 wt % Cr; up to 3 wt % Cu; up to 3 wt % Ni; up to 20 wt % Mg; 0.01 to 7 wt % Al; up to 13 wt % Ba; 0.01 to 7 wt % Ca; up to 13 wt % Mn; up to 8 wt % Zr; up to 4 wt % La and/or Ce and/or misch metal; up to 5 wt % Sr; up to 3 wt % Bi; up to 3 wt % Sb; up to 0.5 wt % Ti; balance Fe and incidental impurities.

4. The FeSi V and/or Nb alloy according to claim 1, wherein the FeSi V and/or Nb alloy comprises from 51-80 wt % Si; 5-35 wt % V and/or Nb; up to 10 wt % Mo; up to 5 wt % Cr; up to 3 wt % Cu; up to 3 wt % Ni; up to 20 wt % Mg; 0.01 to 7 wt % Al; up to 13 wt % Ba; 0.01 to 7 wt % Ca; up to 13 wt % Mn; up to 8 wt % Zr; up to 4% La and/or Ce and/or misch metal; up to 5 wt % Sr; up to 3 wt % Bi; up to 3 wt % Sb; up to 0.5 wt % Ti; balance Fe and incidental impurities.

5. The FeSi V and/or Nb alloy according to claim 1, comprising up to 15 wt % Mg.

6. The FeSi V and/or Nb alloy according to claim 1, comprising up to 5 wt % Mo.

7. The FeSi V and/or Nb alloy according to claim 1, wherein the FeSi V and/or Nb alloy has a melting temperature range from 1060 to 1640° C.

8. The FeSi V and/or Nb alloy according to claim 1, wherein the FeSi V and/or Nb alloy is in the form of particles or lumps having a sizing of 0.06 mm to 50 mm.

9. The FeSi V and/or Nb alloy according to claim 8, wherein the FeSi V and/or Nb particles or lumps are coated or mixed with bismuth oxide, and/or bismuth sulfide, and/or antimony sulfide, and/or antimony oxide, and/or iron oxide, and/or iron sulphide.

10. The FeSi V and/or Nb alloy according to claim 1, wherein the FeSi V and/or Nb alloy is an additive for use in production of cast iron.

11. An additive comprising the-FeSi V and/or Nb alloy according to claim 1 for use in the manufacture of vanadium and/or niobium containing cast iron.

12. A method for production of a ferrosilicon vanadium and/or niobium (FeSi V and/or Nb) alloy according to claim 1, the method comprises:

providing a ferrosilicon alloy in molten state;

adding vanadium oxide containing raw material and/or niobium oxide containing raw material to the molten ferrosilicon alloy, where the vanadium oxide containing raw material and/or niobium oxide containing raw material is added in an amount (by weight) providing essentially the target amount of elemental vanadium and/or niobium (by weight) in the FeSi V and/or Nb alloy;

mixing and reacting the molten ferrosilicon alloy and vanadium oxide from the vanadium oxide containing raw material and/or niobium oxide from the niobium oxide containing raw material, thereby forming a melt of FeSi V and/or Nb alloy and slag;

separating the slag from the said melt; and solidifying or casting the molten FeSi V and/or Nb alloy.

13. The method according to claim 12, where the molten ferrosilicon alloy is provided directly from a reduction furnace, wherein ferrosilicon is as-produced from raw materials according to conventional methods.

14. The method according to claim 12, where the molten ferrosilicon alloy is provided by re-melting a charge of ferrosilicon alloy.

15. The method according to claim 12, wherein the vanadium oxide containing raw material is one or more vanadium oxide phases selected from vanadium (II) oxide, vanadium (III) oxide, vanadium (IV) oxide, vanadium (V) oxide, and/or other non-principal oxides of vanadium and/or niobium oxide raw material is one or more niobium oxide phases selected from niobium (II) oxide, niobium (III) oxide, niobium (IV) oxide, niobium (V) oxide, and/or other non-principal oxides of niobium.

16. The method according to claim 15, where the vanadium oxide phase is vanadium (V) oxide, $V_2O_5$ and/or vanadium (III) oxide, $V_2O_3$ and/or niobium oxide phase is niobium (V) oxide, $Nb_2O_5$ and/or niobium (III) oxide, $Nb_2O_3$.

17. The method according to claim 15, wherein the vanadium oxide containing raw material further comprises industrial waste material or ore comprising vanadium oxide, and/or the niobium oxide containing raw material further comprises industrial waste material or ore comprising niobium oxide.

18. The method according to claim 12, where a slag modifying compound is added to the molten ferrosilicon alloy in an amount of 0.5-30 wt %, based on the total amount of ferrosilicon alloy and vanadium oxide and/or niobium oxide.

19. The method according to claim 18, wherein the slag modifying compound is at least one of CaO and MgO.

20. The method according to claim 12, wherein the molten starting ferrosilicon alloy comprises:

40-90 wt % Si;

up to 0.5 wt % C;

0.01-7 wt % Al;

up to 6 wt % Ca;

up to 1.5 wt % Ti;

up to 15 wt % Mn;

up to 10 wt % Cr;

up to 10 wt % Zr;

up to 15 wt % Ba;

up to 0.3 wt % P;

up to 0.5 wt % S;

the balance being Fe and incidental impurities.

21. The method according to claim 12, further comprising adding aluminium to the ferrosilicon melt, prior to, simultaneously, or after the addition of the vanadium oxide containing raw material and/or the niobium oxide containing raw material, in an amount of up to 10 wt %, based on the total amount of ferrosilicon and vanadium oxide and/or niobium oxide.

22. The method according to claim 12, wherein the molten ferrosilicon alloy and the vanadium oxide containing raw material and/or the niobium oxide containing raw material, and any added aluminium and/or slag modifying compound, are mixed by mechanical stirring or gas stirring.

23. The method according to claim 12, wherein the slag is separated before or during casting of the molten ferrosilicon vanadium and/or niobium alloy.

24. The method according to claim 12, wherein the solidified casted FeSi V and/or Nb is formed into blocks or crushed and optionally graded in size fractions or agglomerated.

* * * * *